US009434533B2

(12) United States Patent
Lucas

(10) Patent No.: US 9,434,533 B2
(45) Date of Patent: Sep. 6, 2016

(54) MODULAR BINS

(71) Applicant: Scott Equipment Company, New Prague, MN (US)

(72) Inventor: Richard V. Lucas, Jordan, MN (US)

(73) Assignee: Scott Equipment Company, New Prague, MN (US)

( * ) Notice: Subject to any disclaimer, the term of this patent is extended or adjusted under 35 U.S.C. 154(b) by 284 days.

(21) Appl. No.: 14/190,483

(22) Filed: Feb. 26, 2014

(65) Prior Publication Data

US 2014/0263303 A1 Sep. 18, 2014

Related U.S. Application Data

(60) Provisional application No. 61/778,696, filed on Mar. 13, 2013.

(51) Int. Cl.

| | |
|---|---|
| ***B65D 8/14*** | (2006.01) |
| ***B65D 88/32*** | (2006.01) |
| *E04H 7/30* | (2006.01) |

(52) U.S. Cl.

CPC ..... *B65D 88/32* (2013.01); *E04H 7/30* (2013.01)

(58) Field of Classification Search

CPC .... B65D 88/00; B65D 88/005; B65D 88/02; B65D 88/26; B65D 88/28; B65D 88/30; B65D 88/32; B65D 88/52; B65D 88/522; B65D 88/526

USPC ..... 220/4.01, 4.21, 4.22, 4.23, 4.24, 4.26, 220/4.27, 4.28, 4.29, 4.31, 4.32, 4.33

See application file for complete search history.

(56) References Cited

U.S. PATENT DOCUMENTS

| | | | | |
|---|---|---|---|---|
| 3,822,521 | A | 7/1974 | Lucas | |
| 4,893,445 | A * | 1/1990 | Hefer | E04C 2/08 52/192 |
| 2006/0091145 | A1* | 5/2006 | Miller | B29C 45/006 220/826 |
| 2012/0306236 | A1* | 12/2012 | Skipper | B62D 33/046 296/193.04 |

* cited by examiner

*Primary Examiner* — Steven A. Reynolds
*Assistant Examiner* — Javier A Pagan
(74) *Attorney, Agent, or Firm* — Vidas, Arrett & Steinkraus, P.A.

(57) ABSTRACT

The modular bins of the present in some embodiments may include a plurality of central junction areas, where each central junction area may be formed of a plurality of central or interior junction members. The modular bins may also include a plurality of side junction areas which may be formed of a plurality of central or interior junction members and at least one side junction member. The modular bins may further include a plurality of corner junction areas which may be formed of at least one central or interior junction member and at least one corner junction member. A plurality of exterior wall panels are engaged to the side junction members and the corner junction members. A plurality of inner wall panels are engaged to the plurality of central or interior junction members to form the modular bins.

20 Claims, 5 Drawing Sheets

MODULAR BINS

CROSS-REFERENCE TO RELATED APPLICATIONS

This application claims the benefit of U.S. Provisional Patent Application Ser. No. 61/778,696 filed Mar. 13, 2013 which is incorporated by reference herein in its entirety.

BACKGROUND OF THE INVENTION

In the past bins have been used for agricultural purposes which include storage and dispensing of grain or feed. Bins have also been used to secure the location of livestock as well as being used for other agricultural purposes.

In the past, bins have failed to provide for the smooth flow of materials during dispensing activities following storage. In addition, the bins as known have frequently been formed of materials of insufficient strength, or have been fabricated in accordance with economic restrictions, which have resulted in the failure of the bins to satisfy the needs of a user.

An additional shortcoming of the bins as known is related to moisture integrity, including but not limited to condensation, where moisture has traversed and/or become trapped within a bin, resulting in spoilage and waste of grain or feed retained within the bin. In conjunction with the issue of moisture integrity, the bins as known have also inadequately protected stored items from freezing, or fire, which result waste of stored feed or grain, and/or harm to livestock.

The bins as known have also failed to be adequately standardized, interchangeable, or modular, and have not permitted a user to arrange the bins in a desired configuration, which may include, but is not necessarily limited to, stacking

SUMMARY

The invention described herein relates to modular bins. The modular bins of the present invention, in some embodiments, may include a plurality of central junction areas where each central junction area may be formed of a plurality of central junction members or interior junction members. The modular bins in some embodiments may also include a plurality of side junction areas, where each of the side junction areas is formed of a plurality of central or interior junction members and at least one side junction member. The modular bins in some embodiments may also include a plurality of corner junction areas, where each corner junction area may be formed of at least one central or interior junction member and at least one corner junction member. In some embodiments, a plurality of exterior wall panels are engaged to the plurality of side junction members and the plurality of corner junction members, where the plurality of exterior wall panels form the perimeter for the modular bins. In some embodiments, a plurality of inner wall panels are engaged to the plurality of central or interior junction members, where the plurality of inner wall panels are substantially parallel to the plurality of exterior wall panels about the perimeter of the modular bins, and a plurality of inner wall panels are substantially parallel to each other proximate to the at least one central junction area.

In some embodiments, the modular bins may also include at least one end cap member which is proximate to a side junction member, an exterior wall panel, an inner wall panel and a central or interior junction member.

In some embodiments, the modular bins may also include at least one end cap member which is proximate to a corner junction member, an exterior wall panel, an inner wall panel and at least one of the central or interior junction members.

In at least one embodiment, the modular bins may also include a central or interior junction member having a first tab, a first section, a second section, a second tab, and a vertical edge between the first section the second section.

In some embodiments, the modular bins may also include a plurality of inner wall panels which are engaged to the plurality of central or interior junction members proximate to the vertical edge.

In at least one embodiment, the modular bins may also include a side junction member having a first shoulder, a first intermediate section, a traverse section, a second intermediate section, and a second shoulder.

In some embodiments, the modular bins may also include a corner junction member having a first projecting edge, a first interval section, a second interval section, a third interval section, a fourth interval section, a fifth interval section, and a second projecting edge.

In at least one embodiment the modular bins may also include a plurality of corner junction areas, where each of the corner junction areas has at least one interior junction member and at least one corner junction member. In some embodiments the modular bins may also include a plurality of exterior wall panels engaged to the corner junction members, where the plurality of exterior wall panels form a perimeter. In some embodiments the modular bins may also include a plurality of inner wall panels engaged to the interior junction members where the plurality of inner wall panels are substantially parallel to the plurality of exterior wall panels about the perimeter of the modular bins.

In some embodiments the modular bins may also include a plurality of side junction areas, where each of the side junction areas has a plurality of interior junction members and at least one side junction member. In some embodiments the modular bins may also include a plurality of corner junction areas, where each of the corner junction areas has at least one interior junction member and at least one corner junction member. In some embodiments the modular bins may also include a plurality of exterior wall panels engaged to the plurality of side junction members, and the plurality of corner junction members, where the exterior wall panels form a perimeter. In some embodiments the modular bins may also include a plurality of inner wall panels engaged to the plurality of interior junction members where the plurality of inner wall panels are substantially parallel to the plurality of exterior wall panels around the perimeter, and the plurality of inner wall panels are substantially parallel to each other proximate to the central junction area.

DETAILED DESCRIPTION OF THE INVENTION

Figure 1:
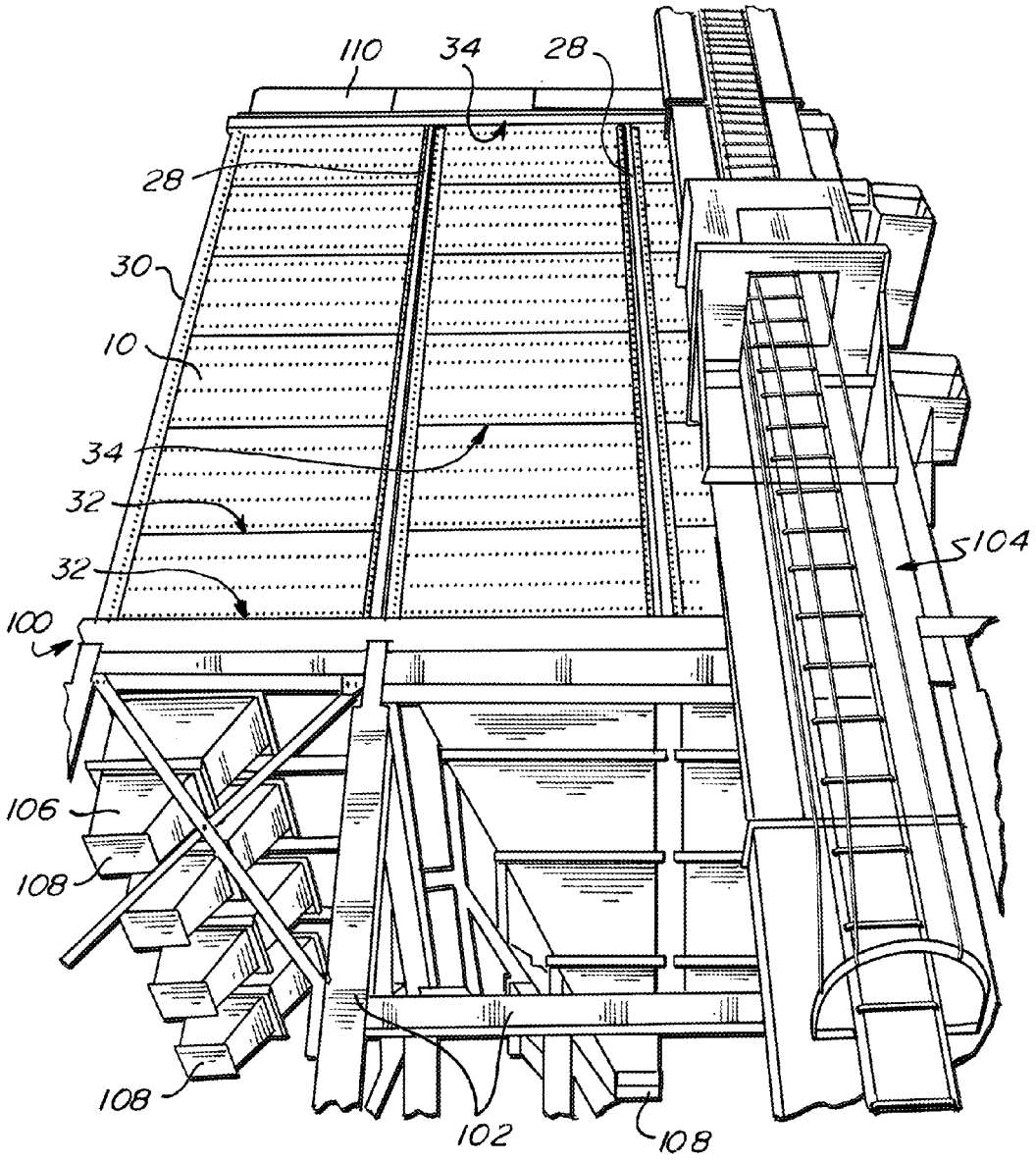
FIG. 1 is an environmental view of one embodiment of a plurality of bins of the present invention arranged into a storage system.

An environmental view of one embodiment of a storage system formed of a plurality of modular bins 10 is depicted in FIG. 1. A Storage system in at least one embodiment may include any desired number of modular bins 10, which may be vertically stacked upon each other, and which may be in excess of, or less than, six in number. The storage system in some embodiments may also include any desired number of modular bins 10 configured adjacent to each other to form a cube, square, rectangle, or other geometric shape. In the embodiment depicted in FIG. 1, the storage system has three modular bins 10 in each horizontal row, and six modular bins 10 in each vertical column. In some embodiments any desired number of rows, and any desired number of columns, of modular bins 10 may be used to form a storage system.

As depicted in FIG. 1, in at least one embodiment, the modular bins 10 may be engaged to a support frame 100 which may be formed of beams 102, ladder assemblies 104, and/or other support structures. In at least one embodiment, dispensing chambers 106 are connected to, and in communication with, the bottom of one or more modular bins 10. The dispensing chambers 106 in at least one embodiment may be used to redirect and/or channel the flow of feed, grain, or other material as stored within one or more modular bins 10 during transfer of the materials. Each dispensing chamber 106 may include a releasable door 108 which in some embodiments may be closed during storage of feed and/or grain.

In at least one embodiment, any combination of releasable doors 108 may be actuated by an individual to provide access to the modular bins 10.

In at least one embodiment, a plurality of modular bins 10 may be sequentially stacked upon each other, where the bottom 32 of one modular bin 10 is releasably secured to the top 34 of an adjacent modular bin 10 through the use of nuts, bolts, screws, and/or other mechanical fasteners. In alternative embodiments, the bottom 32 of one modular bin 10 may be permanently secured to the top 34 of an adjacent modular bin 10 through the use of welding or other permanent mechanical affixation techniques or devices.

In alternative embodiments, adjacent and/or stacked modular bins 10 may be releasably or permanently secured in a desired position relative to each other through the use of corner junction members 30, side junction members 28, and/or central or interior junction members 26. In alternative embodiments, bins 10 may be held in a stacked configuration through the use of support structure such as beams 102, brackets, braces, or other mechanical devices which may be affixed or secured to the interior or exterior of adjacent bins 10. In another alternative embodiment, the bins 10 may be held in a stacked configuration without the use of additional mechanical devices.

In an alternative embodiment, one or more columns or rows of modular bins 10 may be in communication with a single dispensing chamber 106, or a plurality of dispensing chambers 106. It should be noted that in some embodiments that the dispensing chamber 106 may be in communication with a single column or row of modular bins 10, and simultaneously a larger dispensing chamber 106 may be in communication with a number of columns or rows of modular bins 10.

As may be seen in FIG. 1, the top 34 of one or more modular bins 10 may be releasably engaged to a cover 110, which may be used to protect grain, feed, or other materials from exposure to moisture and/or other environmental conditions. In some embodiments, a cover 110 is disposed over the top 34 of each modular bin 10. In other embodiments, a cover 110 may be disposed over the top 34 of a plurality of modular bins 10. In alternative embodiments, the modular bins 10 may be open to the environment.

In at least one embodiment, the modular bins 10 may be formed of 14 gauge metal material. In alternative embodiments, the modular bins 10 may be formed of a larger or small gauge of metal material as desired for a particular application. In other embodiments, the modular bins 10 may be formed of iron, steel, stainless steel, carbon steel, galvanized metal material, aluminum, and/or any other metallic, non-metallic, plastic, or composite material, or combinations of composite and plastic materials, or combinations of metallic materials as desired, provided that the materials selected are of sufficient strength and durability to permit stacking, or placement of the modular bins 10 into any desired configuration, without fracture and/or failure. In some embodiments, the modular bins 10 are formed of a material which is resistant to rust or corrosion. It should be noted that the materials identified herein for the modular bins 10 are not exhaustive of the types of materials which may be used, and the bins 10 may be formed of other materials including fiberglass.

In at least one embodiment, the modular bins 10 as described herein are preferably formed of material which is moisture resistant, temperature resistant, fire resistant, and/or resistant to other types of environment penetration. In some embodiments, the modular bins 10 are standardized in dimensions and in configuration, facilitating interchangeability, replacement, stacking, and/or arrangement into a desired shape or size of storage system.

Figure 2:
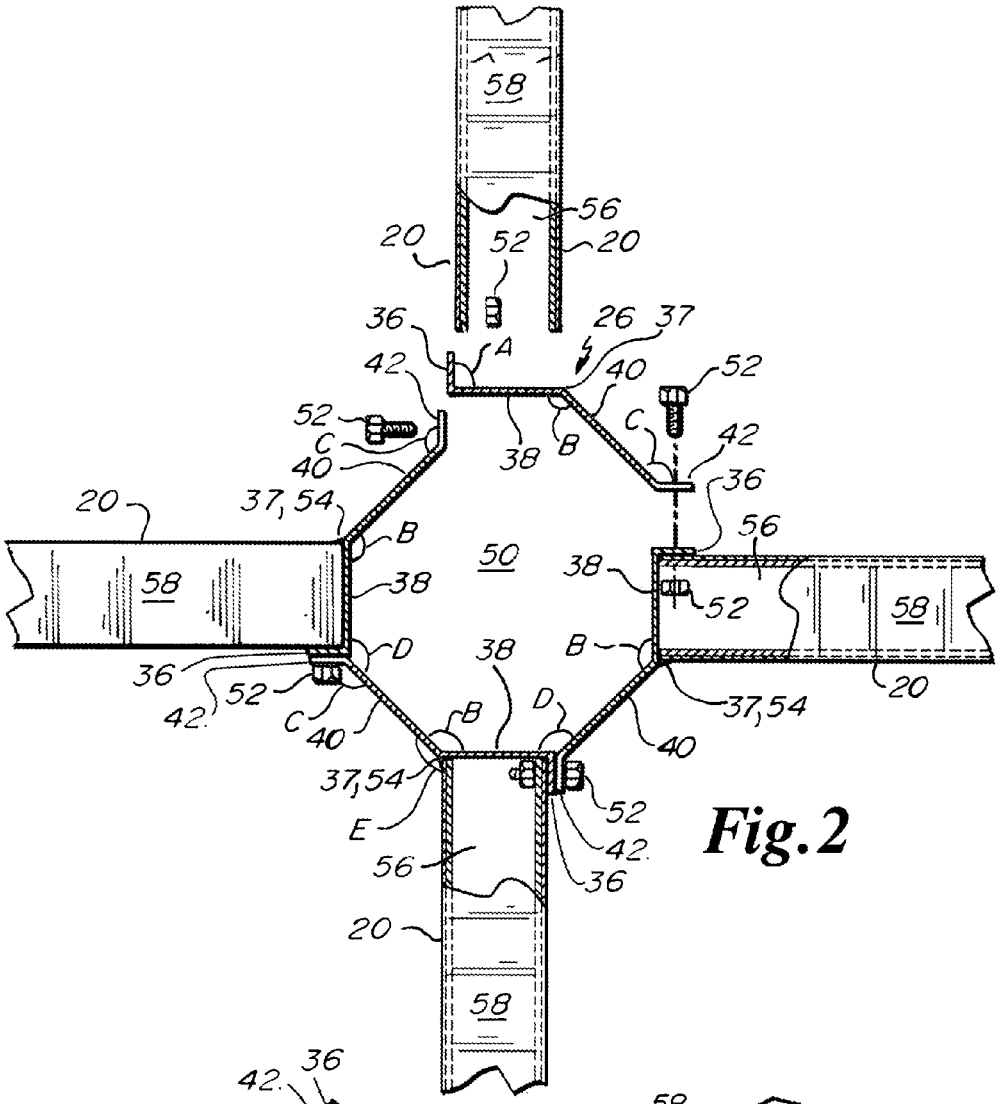
FIG. 2 is a detail partial cross-sectional top view, partial cut-away view, of one embodiment of a central junction area of the present invention.

FIG. 2 is a top partial phantom line, partial cut-away view of one embodiment of a central junction area 50.

In general, in at least one embodiment, a central junction area 50 is formed of four central or interior junction members 26 and at least two inner wall panels 20 engaged to each central junction member 26. As may be seen in FIGS. 2 and 3, in at least one embodiment, each central or interior junction member 26 may include a first tab 36 a first section 38, a second section 40 and a second tab 42. Each central or interior junction member 26 is preferably formed of sturdy metallic or plastic material which is of unitary construction. In alternative embodiments, the portions of the central or interior junction member 26 may be joined to each other along the seams between adjacent sections or tabs by permanent affixation techniques such as welding.

In at least one embodiment, the first tab 36 may be formed by bending relative to the first section 38. The first tab 36 is preferably bent/disposed at an angle as depicted by letter "A" relative to the first section 38. Angle "A" is approximately 90°. It should be noted that angle "A" may be larger or smaller and 90° in alternative embodiments. In some embodiments, the first tab 36 may be permanently or releasably affixed to the first section 38 by any desired mechanical affixation technique including welding.

In at least one embodiment the first tab 36 has a width dimension of approximately 1 inch. In other embodiments, the first tab 36 may have a width dimension of more or less than 1 inch. In at least one embodiment, the first tab 36 has a length/height dimension of approximately 60 inches. In other embodiments, the length/height dimension for the first tab 36 may be more or less than 60 inches as desired for a particular application. In some embodiments, thickness dimension for the metallic or plastic material forming the first tab 36 may be ⅜ inch. In other embodiments the thickness dimension for the metallic or plastic material forming the first tab 36 may be more or less than ⅜ inch. In at least one embodiment, the first tab 36 may include a plurality of apertures which are constructed and arranged to receive mechanical fasteners 52 which may be bolts and nuts. In some embodiments the apertures disposed along the first tab 36 may be regularly spaced part from each other, and in other embodiments, the apertures may be disposed at irregular intervals relative to each other. Alternatively, apertures may be threaded for receipt of threaded fasteners to facilitate affixation of adjacent panels together. It should be noted that other affixation means may be used which have various head configurations including but not necessarily limited to Phillips, slotted, star shaped, Allen, hexagonal or any other desired shape. It should be noted that in certain embodiments the design of the fasteners 52 may be selected for utilization with power equipment to facilitate releasable affixation into modular bins 10.

In some embodiments, the first tab 36 extends outwardly from the first section 38. In at least one embodiment, the first section 38 has a width dimension of approximately 3½ inches. In other embodiments, the width dimension for the first section 38 may be larger or smaller than 3½ inches as desired for a particular application. In at least one embodiment, the first section 38 may have a height dimension of approximately 60 inches. In other embodiments, the first section 38 may have a height dimension which may be larger or smaller than 60 inches as desired for a particular application. In at least one embodiment, the thickness dimension for the first section 38 is identical to the thickness dimension selected for the first tab 36, which may be ⅜ inch. In other embodiments the thickness dimension of the first section 38 may be larger or smaller than ⅜ inch, and may be identical to, or different than, the thickness dimension selected for the first tab 36.

In at least one embodiment, the second section 40 is disposed at an angle "B" relative to the first section 38. At least one embodiment angle "B" is 135°. In other embodiments, the dimensions selected for angle "B" may be larger or smaller than 135°.

In at least one embodiment, the first section 38 is formed by bending the metallic material of the central or interior junction member 26 relative to the second section 40. In an alternative embodiment, the first section 38 may be permanently or releasably affixed to the second section 40 by any desired mechanical affixation technique including welding.

In at least one embodiment, the second section 40 has a width dimension of 4⅜ inches. In alternative embodiments, the width dimension selected for the second section 40 may be larger or smaller than 4⅜ inches as desired for a particular application. In at least one embodiment, the second section 40 may have a height dimension of approximately 60 inches. In other embodiments, the height dimension for the second section 40 may be larger or smaller than 60 inches as desired for a particular application. In at least one embodiment, the thickness dimension for the second section 40 is identical to the thickness dimension selected for the first tab 36, and the first section 38, and is ⅜ inch. In other embodiments, the thickness dimension for the second section 40 may be larger or smaller than one or both of the first tab 36 and the first section 38.

Figure 3:
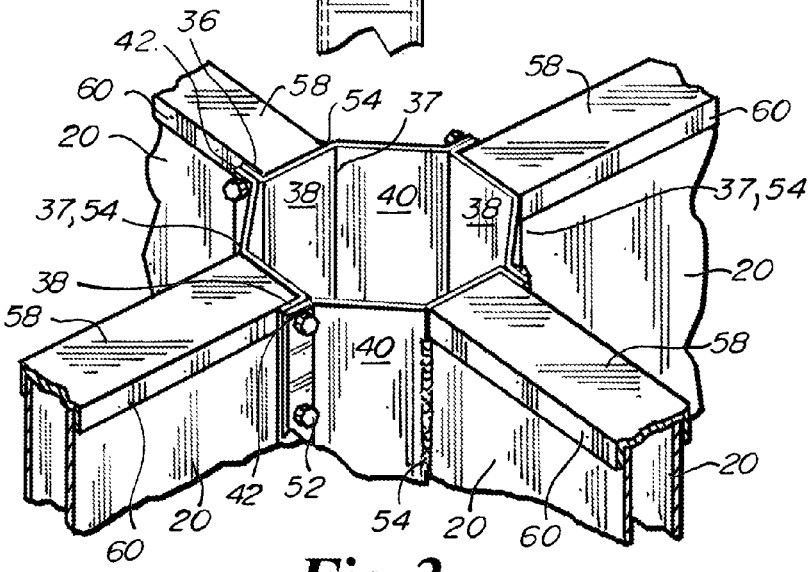
FIG. 3 is a detail isometric view of one embodiment of a central junction area of the present invention.

As may be seen in FIGS. 2 and 3, in at least one embodiment, a second tab 42 is integral with the second section 40 and may be formed by bending the distal end of the second section 40 in the direction of first tab 36, to form an angle depicted by the letter "C".In at least one embodiment, angle "C" is 135°. It should be noted that angle "C" may be larger or smaller than 135° in alternative embodiments. Angle "C" is preferably disposed in a direction opposite to angle "B", where angle "B" and angle "C" are alternate exterior angles relative to each other.

In at least one embodiment, the second tab 42 has a width dimension of 1 inch. In other embodiments, the second tab 42 may have a width dimension which is greater or less than 1 inch as desired for a particular application. In at least one embodiment, the second tab 42 has a length/height dimension of 60 inches. In other embodiments, the length/height dimension selected for the second tab 42 may be larger or smaller than 60 inches as desired for a particular application. In some embodiments, the thickness dimension for the material forming the second tab 42 may be ⅜ inch. In other embodiments, the thickness dimension of the second tab 42 may be larger or smaller than ⅜ inch, and may be identical to, or larger or smaller than, the thickness dimensions selected for the first tab 36, the first section 38, and/or the second section 40.

In at least one embodiment, the second tab 42 includes a plurality of apertures which are constructed and arranged to receive mechanical fasteners 52, which in some embodiments may be bolts and nuts. In some embodiments, the apertures are disposed along the second tab 42 at regular spacing intervals relative to each other. In other embodiments, the apertures are disposed along the second tab 42 at irregular spacing intervals relative to each other.

In at least one embodiment, a plurality of inner wall panels 20 are engaged to each central junction member 26. In some embodiments each inner wall panel 20 has a thickness dimension of ⅜ inch and is formed of metallic material. In some embodiments, each inner wall panel 20 has a height dimension of approximately 60 inches, and a length dimension of approximately 38 inches. In other embodiments, the thickness, height, and length dimensions for the inner wall panels 20 may be larger or smaller than the dimensions indicated immediately above.

In at least one embodiment, each inner wall panel 20, when engaged to a central junction member 26, is substantially parallel to an adjacent inner wall panel 20.

In at least one embodiment, the central junction area 50 is formed of four central or interior junction members 26, which are sequentially engaged to each other. In some embodiments, a first tab 36 of a central or interior junction member 26 is engaged to a second tab 42 of an adjacent central or interior junction member 26. In at least one embodiment, the engagement of the first tab 36 of one interior junction member 26 to the second tab 42 of an adjacent central or interior junction member 26, assists in the formation of an octagonal shape for the central junction area 50. In at least one embodiment, the width dimensions for the first sections 38 of the four central or interior junction members 26 are equal, and the dimensions for the second sections 40 of the four central junction members 26 are equal. In at least one embodiment, the dimensions for all of the first sections 38 and all of the second sections 40 of the central or interior junction members 26 are equal. In at least one embodiment, the width dimension selected for the first tab 36 is equal to the width dimension selected for the second tab 42. In other embodiments, the width dimension selected for the first tab 36 is not equal to the width dimension selected for the second tab 42.

In at least one embodiment, the first tab 36, second tab 42, and inner wall panel 20 may be engaged to each other in any desired combination. For example, in one embodiment, a first tab 36 may be sandwiched in between the second tab 42 and an inner wall panel 20. In an alternative embodiment, an inner wall panel 20 may be sandwiched in between the first tab 36 and a second tab 42. In an alternative embodiment, a second tab 42 may be sandwiched in between a first tab 36 and an inner wall panel 20.

In at least one embodiment, each of the apertures through the first tab 36, second tab 42 and inner wall panel 20 may be uniformly spaced apart from each other, where the apertures through the first tab 36, second tab 42, and inner wall panel 20 may be aligned for receipt of fasteners 52, which are used to releasably secure the central junction area 50 together.

In at least one embodiment, adjacent inner wall panels 20 are substantially parallel to each other. In some embodiments, the inner wall panel 20 may be fixedly secured to the central junction member 26 along the vehicle edge 37 where the first section 38 joins the second section 40. In some embodiments, the inner wall panel 20 is affixed to the central or interior junction member 26 on the opposite side relative to angle "B". In at least one embodiment, the inner wall panel 20 is affixed to the central or interior junction member 26 along vertical edge 37 by welding 54, which extends approximately the entire height dimension of the inner wall panel 20.

In at least one embodiment, the central junction area 50 includes four sets of paired and parallel inner wall panels 20.

In at least one embodiment, an angle "D" is established within the interior of the central junction area 50, between the first section 38 of a first central or interior junction member 26, and a second section 40 of an adjacent central or interior junction member 26. In at least one embodiment, the dimension for angle "D" is equal to the dimension of angle "B" and the dimension of angle "C" which is 135°.

In at least one embodiment, an angle depicted by the letter "E" is established between an inner wall panel 20 and a second section 40 of a central or interior junction member 26. In at least one embodiment, the dimension for angle "E" is equal to the dimensions for angles "B", "C", and "D".

In at least one embodiment, the materials selected for the inner wall panels 20, as well as the positioning of the central or interior junction members 26 relative to the inner wall panels 20, facilitate the free flow of grain or feed as disposed within the modular bins 10. Angles "B", "C", "D", and "E" in some embodiments, minimize the retention of grain or feed within the corners of the modular bins 10, thereby improving the performance of the modular bins 10.

In at least one embodiment, a space 56 exists between adjacent inner wall panels 20. Space 56 in some embodiments may receive material used for insulation. Space 56 in some embodiments may also include internal structural support elements which may include, but are not necessarily limited to the use of bridges, struts, braces, frame members, reinforcement ribs, and/or supports which may extend between the interior of adjacent inner wall panels 20. In some embodiments, frame members may form a rectangle or square perimeter interior to an inner wall panel 20. In some embodiments, internal structure support elements may be used to reinforce adjacent inner wall panels 20, or an adjacent inner panel 20 and outer wall panel 22 to enhance the strength of the modular bins 10.

In at least one embodiment, a cover 58 may be disposed over adjacent inner wall panels 20 to enclose space 56. In some embodiments, cover 58 may include ledges 60 which may be positioned to the exterior of the inner wall panels 20. In other embodiments, the cover 58 may be releasably disposed over space 56 and inner wall panels 20. In alternative embodiments, the cover 58 may be securely attached to the inner wall panels 20 to enclose space 56. In some embodiments, cover 58 is permanently affixed to inner wall panels 20 enclosing space 56. In at least one embodiment, cover 58 is constructed and arranged to minimize the exposure of environmental conditions, including not necessarily limited to, dust, debris, whether, and/or moisture into space 56.

In at least one embodiment, the cover 58 improves the performance of modular bins 10 for use with livestock, feed, and/or or grain. In some embodiments, the cover 58 is not used to enclose space 56.

In some embodiments a portion of ledge 60 may be sandwiched in between any combination of a first tab 36, second tab 42, and an inner wall panel 20. In some embodiments, a portion of a ledge 60 may include an aperture which may be aligned with apertures through a first tab 36, second tab 42, and an inner wall panel 20 to receive at least one fastener 52. In at least one embodiment as depicted in FIG. 3, a ledge 60 is disposed exterior to inner wall panel 20, and interior relative to a first tab 36 and second tab 42.

Figure 4:
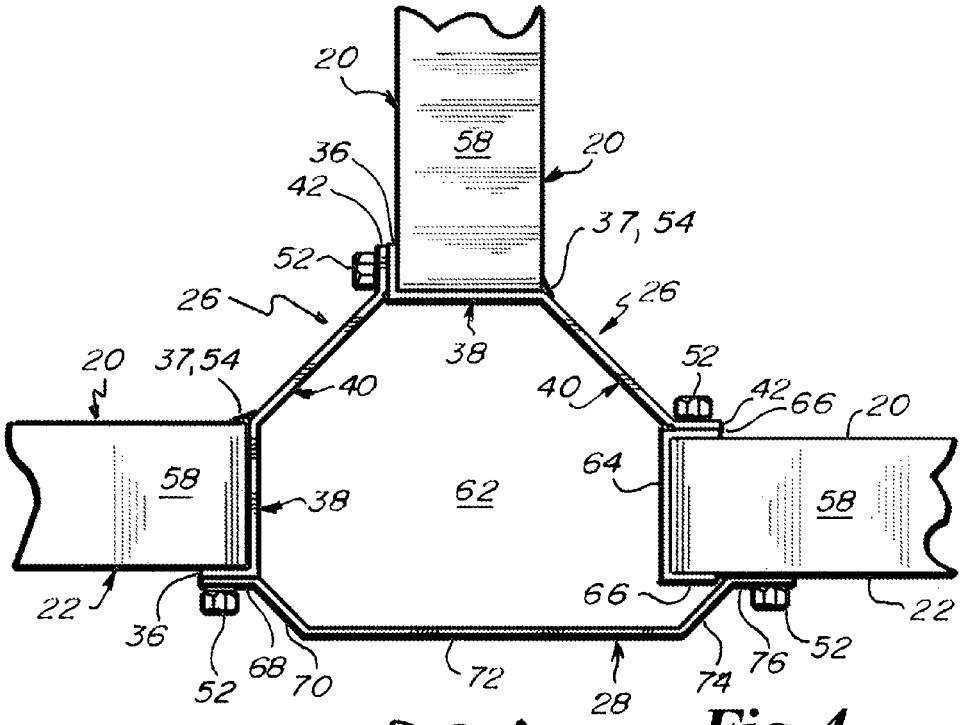
FIG. 4 is a detail partial cross-sectional top view, partial cut-away view, of one embodiment of a side junction area of the present invention.
Figure 5:
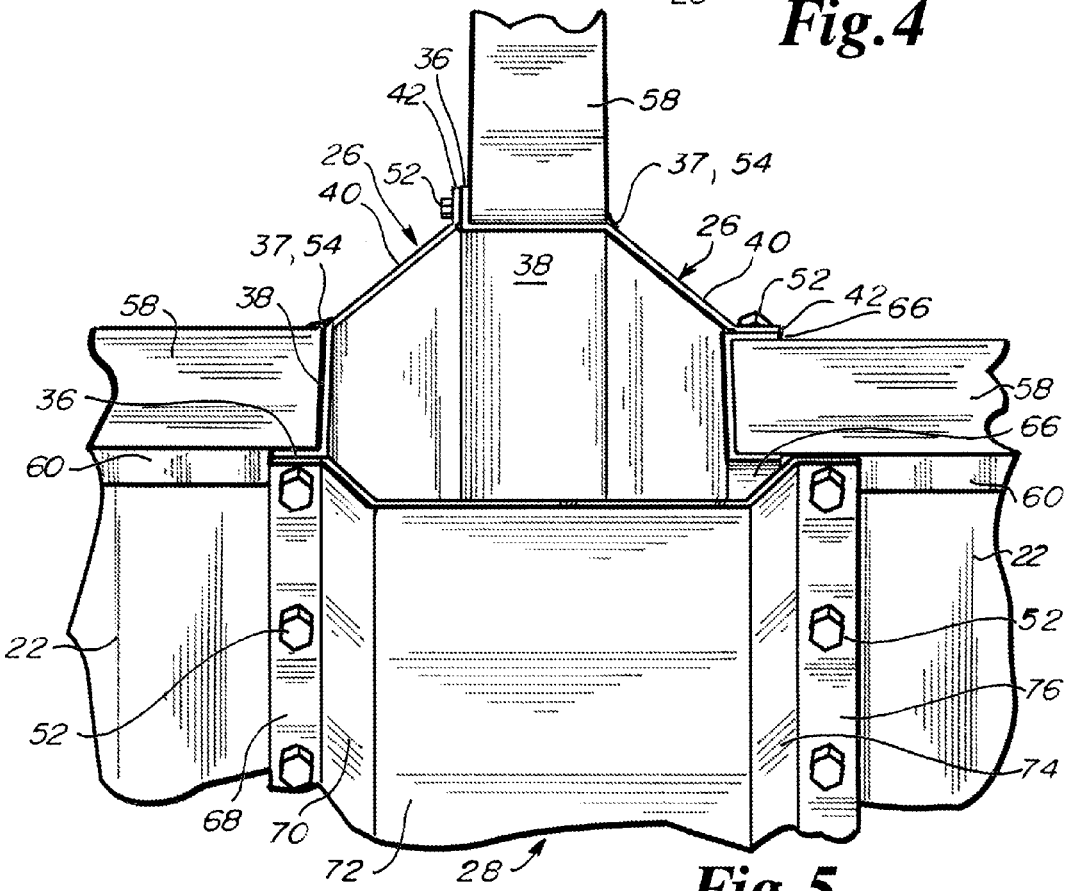
FIG. 5 is a detail isometric view of one embodiment of a side junction area of the present invention.

In FIGS. 4 and 5, in at least one embodiment, a side junction area 62 is depicted. In some embodiments, a side junction area 62 includes two central or interior junction members 26. In some embodiments, each side junction area 62 will include two outer or exterior wall panels 22 and four inner wall panels 20. The earlier description for the central or interior junction members 26 and the inner wall panels 20 is equally applicable for the side junction area 62.

In at least one embodiment, each side junction area 62 preferably includes an end cap member 64 having flanges 66. In some embodiments, a side junction area 62 also includes at least two aligned outer wall panels 22.

In other embodiments, the at least one flange 66 includes apertures which are regularly or irregularly spaced apart from each other along the height dimension for the end cap member 64. In at least one alternative embodiment, the apertures through the flange 66 are aligned with the apertures through the second tab 42, and are constructed and arranged to receive fasteners 52 as earlier described. In some embodiments, the apertures through the flange 66 are aligned with apertures through the first tab 36, and are constructed and arranged to receive fasteners 52 as earlier described.

In other embodiments, at least one fastener 52 attaches a central or interior junction member 26 to an outer wall panel 22. In some embodiments, the outer wall panels 22 have dimensions which may be identical to, smaller than, and/or larger than the inner wall panels 20. In other embodiments, an end cap member 64 may be either fixedly or releasably engaged to an outer wall panel 22 and an inner wall panel 20.

In at least one embodiment the two outer wall panels 22 of a side junction area 60 are substantially horizontally aligned relative to each other. In some embodiments, each of the outer wall panels 22, and respective inner wall panels 20, are substantially parallel to each other defining a space 56 there between. The space 56 between an outer wall panel 22 and an inner wall panel 20 may receive material used as insulation, internal structural elements, bridges, struts, braces, frame members, and/or supports as earlier described. In some embodiments, frame members may form a rectangular or square perimeter within the space 56 between an outer wall panel 22 and the corresponding inner wall panel 20.

In each side junction area 62, in at least one embodiment, a cover 58 may be disposed over an outer wall panel 22 and a corresponding inner wall panel 20, which may enclosed space 56 as earlier described relative to a pair of parallel inner wall panels 20.

In at least one embodiment, the ledges 60 of covers 58 are positioned to engage at least one flange 66. In some embodiments, at least one flange 66 may be sandwiched in-between second tab 42 and inner wall panel 20 and/or ledge 60 of cover 58. In some embodiments, a fastener 52 may pass through apertures through second tab 42, ledge 60, flange 66 and outer wall panel 22, in order to releasably attach a central or interior junction member 26 to an inner wall panel 20.

In at least one embodiment, the side junction area 62 includes at least one side junction member 28. A side junction member 28 may be formed of 14 to 18 gauge aluminized metallic material, and may have dimensions of approximately 60 inches in height, and have width dimension of between 11 inches and 16 inches. In some embodiments, a side junction member 28 will have a thickness dimension of approximately ⅜ inch. In other embodiments the size and/or thickness dimensions identified for the side junction member 28 may be increased or decreased for use in a particular application.

In at least one embodiment, a side junction member 28 is formed of a first shoulder 68, a first intermediate section 70, a traverse section 72, a second intermediate section 74, and a second shoulder 76. In some embodiments, the first shoulder 68 and the second shoulder 76 include regularly or irregularly spaced apertures which are adapted to receive fasteners 52 which may be used to releasably attach a side junction member 28 to an outer wall panel 22.

In at least one embodiment, the dimension selected for the traverse section 72 is sufficiently large so that the second intermediate section 74 positions the second shoulder 76 against the exterior of an outer wall panel 22 a sufficient distance to not engage a flange 66. In other embodiments, a second shoulder 76 may engage a flange 66. In some embodiments, the top of one or both of the first shoulder 68 and the second shoulder 76 engage a ledge 60 of a cover 58. In other embodiments, the engagement of the top of one or both of the first shoulder 68 and second shoulder 76 to either of the first tab 36, ledge 60, flange 66, and/or outer wall panel 22, occurs through the use of fasteners 52 positioned to the exterior of ledges 60. Fasteners 52 may assist in the retention of the cover 58 on the outer wall panels 22. In some embodiments, the exterior ledge 60 may be sandwiched in between the second shoulder 76 and the outer wall panel 22. In other embodiments, the exterior ledge 60 may be sandwiched in between the first shoulder 68 and/or the first tab 36 or the outer wall panel 22. In other embodiments, the exterior ledge 60 may be exterior two, interior of, or sandwiched in between, any of the elements of the first shoulder 68 second shoulder 76, the first tab 36, flange 66, ledge 60, and/or the outer wall panel 22.

In some embodiments, the side junction member 28 is releasably secured to the exterior of an outer wall panel 22 through the use of fasteners 52. In other embodiments, side junction number 28 may be permanently affixed to the exterior of an outer wall panel 22 through the use of welds or other permanent affixation techniques or devices.

In some embodiments, the use of a central junction member 26 and side junction number 28 in combination with the outer wall panels 22 and inner wall panels 20 facilitate the assembly of modular bins 10 into any desired square, rectangular, or other shape or configuration. In some embodiments, any desired number of modular bins 10 may be assembled in any desired shape, pattern, or configuration.

In at least one embodiment, at least one inner wall panel 20 is permanently affixed to the vertical edge 37 of a respective central or interior junction member 26 by welding 54. The permanent attachment of an inner wall panel 20 to a central junction member 26 may occur in a central junction area 50, a side junction area 62, or a corner junction area 80. In some embodiments, inner wall panels 20 may be releasably affixed to a respective central or interior junction member 26 by fasteners 52. The releasable attachment of an inner wall panel 20 to a central junction member 26 may occur in a central junction area 50, a side junction area 62, or a corner junction area 80. In other embodiments, inner wall panels 20 are disposed to the interior of the modular bins 10, and outer wall panels 22 are generally horizontally aligned (or perpendicular at the corners) around the perimeter of one or more modular bins 10.

Figure 6:
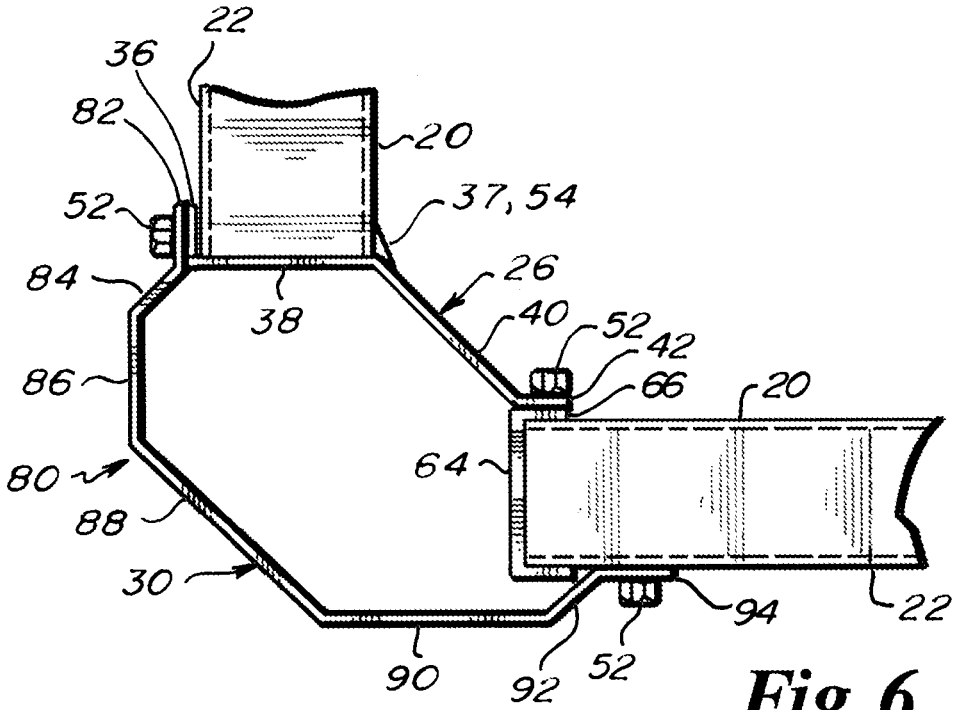
FIG. 6 is a detail partial cross-sectional top view, partial cut-away view, of one embodiment of a corner junction area of the present invention.
Figure 7:
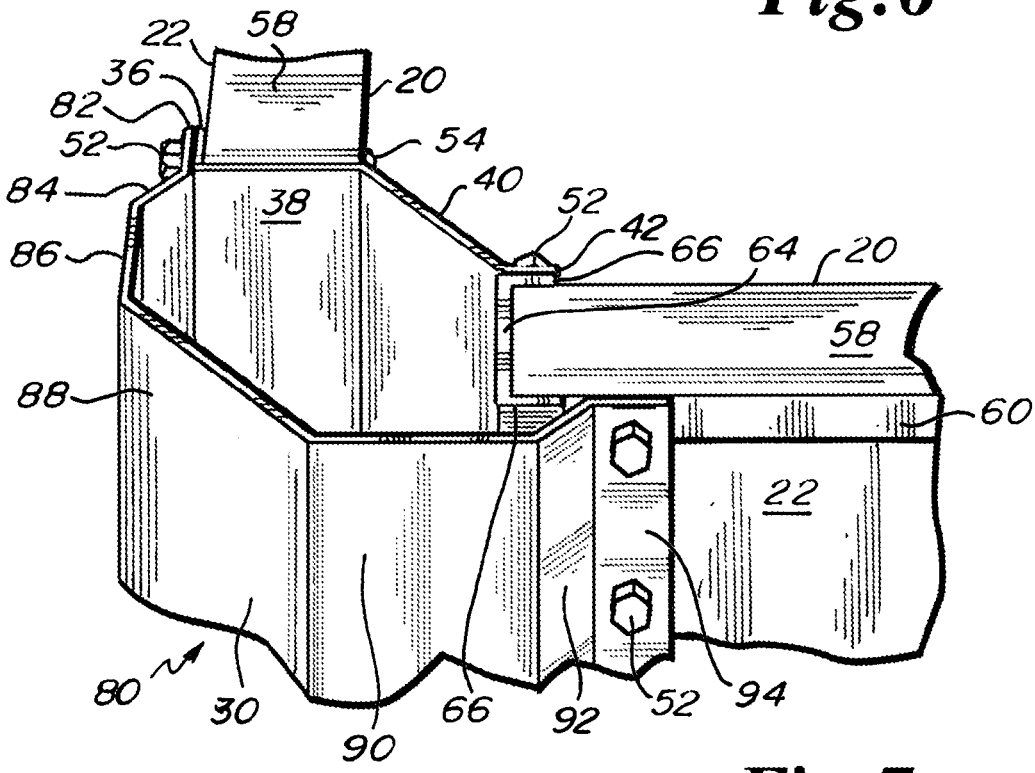
FIG. 7 is a detail isometric view of one embodiment of a corner junction area of the present invention.

As may be seen in FIGS. 6 and 7, in at least one embodiment a corner junction area 80 is shown. In some embodiments, a corner junction 80 includes at least one central or interior junction member 26, at least one inner wall panel 20 engaged to at least one central junction member 26 proximate to a vertical edge 37, and at least one inner wall panel 20 engaged to a central junction member 26 proximate to second tab 42. The earlier description for the central junction member 26, inner wall panels 20, first tab 36, first section 38, second section 40, and second tab 42 are equally applicable to a corner junction area 80.

In at least one embodiment, a corner junction area 80 may include an end cap member 64 as earlier described. In some embodiments, a corner junction area 80 may include at least two outer wall panels 22 which are positioned substantially perpendicular to each other relative to the corner junction area 80. In at least one embodiment, the end cap member 64 is fixedly or releasably secured to at least one of an inner wall panel 20, an outer wall panel 22, or a central junction member 26 as earlier described. With respect to the corner junction area 80, in some embodiments, at least one outer wall panel 22 and at least one inner wall panel 20 are fixedly and/or releasably secured to at least one central junction member 26 as earlier described.

In some embodiments, the outer wall panels 22 and the inner wall panels 20 as used in corner junction area 80 have dimensions which may be identical to, smaller and/or larger than the outer wall panels 22 and inner wall panels 20 as earlier described. In at least one embodiment, an outer wall panel 22 and a respective inner wall panel 20 are substantially parallel to each other defining a space 56 there between. The space 56 in some embodiments may include material used as insulation or structural materials/elements as earlier described. In some embodiments, a cover 58 may be used to enclose the space 56 between an adjacent inner wall panel 20 and an outer wall panel 22 in corner junction area 80. The earlier description of the features, functions, and engagement of the cover 58 to outer wall panels 22 and inner wall panels 20 are equally applicable within the corner junction area 80.

In at least one embodiment, the corner junction area 80 includes at least one corner junction member 30. In some embodiments, corner junction member 30 may be formed of 14 to 18 gauge aluminized metallic material having dimensions of approximately 60 inches in height, and a width dimension of between 10 and 18 inches. In some embodiments, the corner junction member 30 has a thickness dimension of approximately ⅜ inch. In other embodiments, the size and/or thickness dimensions identified for the corner junction member 30 may be increased or decreased for use in a particular application.

In at least one embodiment, a corner junction member 30 may be formed of a first projecting edge 82, a first interval section 84, a second interval section 86, a third interval section 88, a fourth interval section 90, a fifth interval section 92, and a second projecting edge 94. In some embodiments, the first projecting edge 82 and the second projecting edge 94 include regularly or irregularly spaced apertures which are adapted to receive fasteners 52 used to releasably affix a corner junction member 32 to an outer wall panel 22.

In at least one embodiment, the dimensions selected for the first interval section 84, the second interval section 86, the third interval section 88, the fourth interval section 90, and the fifth interval section 92 are sufficiently large so that the second projecting edge 94 is positioned to the exterior of an outer wall panel 22, a sufficient distance to not engage a flange 66. In other embodiments, the second projecting edge 94 may engage a flange 66 for use in a particular application.

In at least one embodiment, the top of one or both of the first projecting edge 82 and the second projecting edge 94, is constructed and arranged to engage one of the ledges 60 of the cover 58. In some embodiments, the engagement of the top of one or both of the first projecting edge 82 and second projecting edge 94, to the ledge 60 may occur through the use of fasteners 52, which assist in retention of the cover 58 on an outer wall panel 22. In other embodiments, the exterior ledge 60 may be sandwiched in-between the second projecting edge 94 and an outer wall panel 22. In other embodiments, the exterior ledge 60 may be sandwiched in between the first projecting edge 82 and/or the first tab 36, or to the outer wall panel 22. In other embodiments, the exterior ledge 60 may be exterior to, interior of, and/or sandwiched in between any of the elements of the first projecting edge 82, second projecting edge 94, the first tab 36, and/or an outer wall panel 22.

In some embodiments, a corner junction member 30 may be releasably secured the exterior of an outer wall panel 22 through the use of fasteners 52. In other embodiments, the corner junction member 30 may be permanently affixed to the exterior of an outer wall panel 22 through the use of welds and/or other permanent affixation techniques or devices.

In some embodiments, the corner junction member 30 and central junction member 26 in combination with the exterior wall panels 22, and interior wall panels 20, facilitate assembly of the modular bins 10 into any desired shape, including but not necessarily limited to cubical, square, rectangular, or other geometric configurations. In some embodiments, any desired number of modular bins 10 may be assembled in any desired shape, pattern, and/or configuration to provide any desired number of rows or columns or cells, to define individual or multiple compartments, or to form a matrix, to hold grain, feed, livestock or other items.

Figure 8:
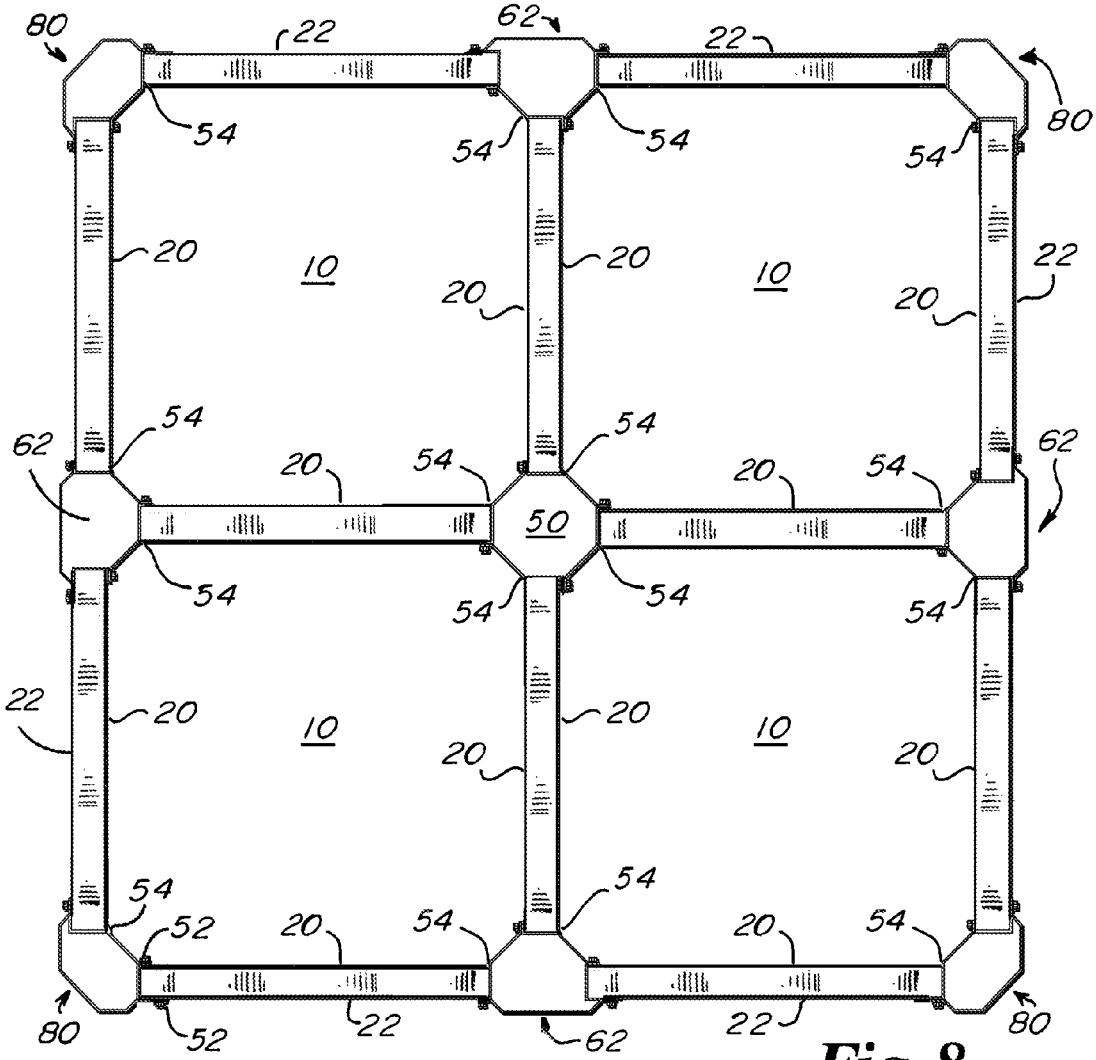
FIG. 8 is an alternative top plan view of one embodiment of a plurality of modular bins arranged into a desired configuration.
Figure 9:
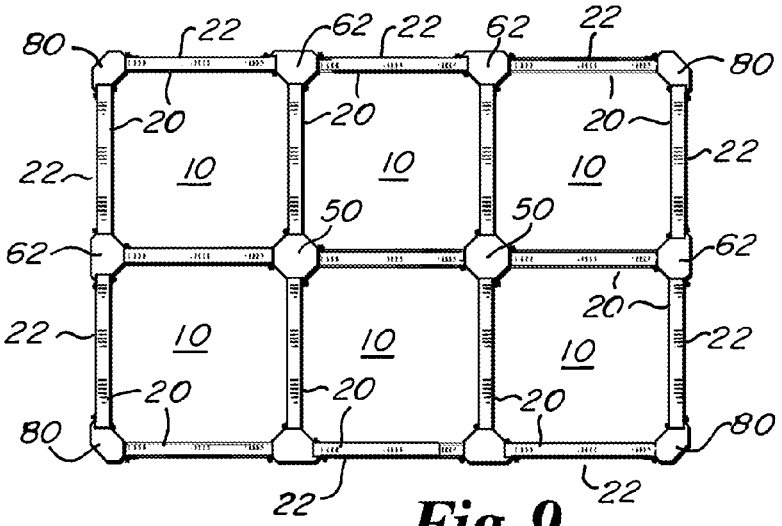
FIG. 9 is in alternative top plan view of one embodiment of a plurality of modular bins arranged into a desired configuration.

In at least one embodiment as depicted in FIG. 8, a plurality of modular bins 10 are arranged in the overall shape of a square. In at least one embodiment as depicted in FIG. 9, a plurality of modular bins 10 are arranged in the shape of a rectangle.

Applicant herein incorporates by reference U.S. Pat. No. 3,822,521 entitled Modular Wall Panel Section and Bolted Wall Construction in its entirety.

In the above description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

While the invention herein disclosed has been described by means of specific embodiments and applications thereof, numerous modifications and variations could be made thereto by those skilled in the art without departing from the scope of the invention set forth in the claims.

The invention claimed is:

1. A set of modular bins comprising:

a. at least one octagonal shaped central junction area comprising four central junction members, each of said central junction members comprising a first tab, a first section, a second section, a second tab, and a first vertical edge between said first tab and said first section, a second vertical edge between said first section and said second section and a third vertical edge between said second section and said second tab;

b. a plurality of side junction areas, each of said side junction areas comprising a plurality of central junction members and at least one side junction member;

c. a plurality of corner junction areas, each of said corner junction areas comprising at least one central junction member and at least one corner junction member;

d. a plurality of smooth outer wall panels engaged to said plurality of side junction members, and said plurality of corner junction members, said plurality of smooth outer wall panels forming a perimeter; and e. a plurality of smooth inner wall panels engaged to said plurality of central junction members wherein said plurality of smooth outer wall panels are substantially parallel to said plurality of smooth inner wall panels about said perimeter, and said plurality of smooth inner wall panels are substantially parallel to each other proximate to said at least one central junction area.

2. The set of modular bins according to claim 1, further comprising at least one end cap member proximate to said at least one side junction member.

3. The set of modular bins according to claim 2, further comprising at least one end cap member proximate to said at least one corner junction member.

4. The set of modular bins according to claim 1, further comprising at least one end cap member proximate to said at least one corner junction member.

5. The set of modular bins according to claim 1, wherein said plurality of smooth inner wall panels are engaged to said plurality of central junction members proximate to said second vertical edge.

6. The set of modular bins according to claim 1, said at least one side junction member comprising a first shoulder, a first intermediate section, a traverse section, a second intermediate section, and a second shoulder.

7. The set of modular bins according to claim 6, said at least one corner junction member comprising a first projecting edge, a first interval section, a second interval section, a third interval section, a fourth interval section, a fifth interval section, and a second projecting edge.

8. The set of modular bins according to claim 1, said at least one corner junction member comprising a first projecting edge, a first interval section, a second interval section, a third interval section, a fourth interval section, a fifth interval section, and a second projecting edge.

9. The set of modular bins according to claim 1, each of said central junction members further comprising a first angle between said first section and said second section, said first angle being approximately 135 degrees.

10. The set of modular bins according to claim 9, each of said central junction members further comprising a second angle between said second section and said second tab, said second angle being approximately 135 degrees.

11. The set of modular bins according to claim 10, wherein said first angle and said second angle are alternate exterior angles relative to each other.

12. A modular bin comprising:

a. a plurality of corner junction areas, each of said corner junction areas comprising at least one interior junction member and at least one corner junction member, said at least one interior junction member comprising a first tab, a first section, a second section, a second tab, and a first vertical edge between said first tab and said first section, a second vertical edge between said first section and said second section and a third vertical edge between said second section and said second tab and said at least one corner junction member comprising a first projecting edge, a first interval section, a second interval section, a third interval section, a fourth interval section, a fifth interval section, and a second projecting edge;

b. a plurality of smooth outer wall panels engaged to said plurality of corner junction members, wherein said plurality of smooth outer wall panels form a perimeter; and c. a plurality of smooth inner wall panels engaged to said interior junction members, wherein said plurality of smooth outer wall panels are substantially parallel to said plurality of smooth inner wall panels about said perimeter.

13. The set of modular bins according to claim 12, each of said interior junction members further comprising a first angle between said first section and said second section, and a second angle between said second section and said second tab, said first angle being approximately 135 degrees and said second angle being approximately 135 degrees, wherein said first angle and said second angle are alternate exterior angles relative to each other.

14. A set of modular bins comprising:

a. a plurality of side junction areas, each of said side junction areas comprising two interior junction members and at least one side junction member, each of said interior junction members comprising a first tab, a first section, a second section, a second tab, and a first vertical edge between said first tab and said first section, a second vertical edge between said first section and said second section and a third vertical edge between said second section and said second tab and said at least one side junction member comprising a first shoulder, a first intermediate section, a traverse section, a second intermediate section, and a second shoulder;

b. a plurality of corner junction areas, each of said corner junction areas comprising at least one of said interior junction members and at least one corner junction member;

c. a plurality of smooth outer wall panels engaged to said plurality of side junction members, and said at least one corner junction member said plurality of smooth outer wall panels forming a perimeter; and d. a plurality of smooth inner wall panels engaged to said plurality of interior junction members, wherein said plurality of smooth outer wall panels are substantially parallel to said plurality of smooth inner wall panels about said perimeter, and wherein a plurality of said smooth inner wall panels are substantially parallel to each other.

15. The set of modular bins according to claim 14, each of said interior junction members further comprising a first angle between said first section and said second section, and a second angle between said second section and said second tab, said first angle being approximately 135 degrees and said second angle being approximately 135 degrees, wherein said first angle and said second angle are alternate exterior angles relative to each other.

16. A set of modular bins comprising:

a. at least one octagonal shaped central junction area comprising four central junction members, each of said central junction members comprising a first tab, a first section, a second section, a second tab, and a first vertical edge between said first tab and said first section, a second vertical edge between said first section and said second section and a third vertical edge between said second section and said second tab;

b. a plurality of side junction areas, each of said side junction areas comprising a plurality of central junction members and at least one side junction member, said at least one side junction member comprising a first shoulder, a first intermediate section, a traverse section, a second intermediate section, and a second shoulder;

c. a plurality of corner junction areas, each of said corner junction areas comprising at least one central junction member and at least one corner junction member, said at least one corner junction member comprising a first projecting edge, a first interval section, a second interval section, a third interval section, a fourth interval section, a fifth interval section, and a second projecting edge;

d. a plurality of smooth outer wall panels engaged to said plurality of side junction members, and said plurality of corner junction members, said plurality of smooth outer wall panels forming a perimeter; and e. a plurality of smooth inner wall panels engaged to said plurality of central junction members wherein said plurality of smooth outer wall panels are substantially parallel to said plurality of smooth inner wall panels about said perimeter, and said plurality of smooth inner wall panels are substantially parallel to each other proximate to said at least one central junction area.

17. The set of modular bins according to claim 16, each of said central junction members further comprising a first angle between said first section and said second section, said first angle being approximately 135 degrees.

18. The set of modular bins according to claim 17, each of said central junction members further comprising a second angle between said second section and said second tab, said second angle being approximately 135 degrees.

19. The set of modular bins according to claim 18, wherein said first angle and said second angle are alternate exterior angles relative to each other.

20. A set of modular bins comprising:

a. at least one octagonal shaped central junction area comprising four central junction members, each of said central junction members comprising a first tab, a first section, a second section, a second tab, and a first vertical edge between said first tab and said first section, a second vertical edge between said first section and said second section and a third vertical edge between said second section and said second tab, each of said central junction members further comprising a first angle between said first section and said second section, said first angle being approximately 135 degrees and a second angle between said second section and said second tab, said second angle being approximately 135 degrees, wherein said first angle and said second angle are alternate exterior angles relative to each other;

b. a plurality of side junction areas, each of said side junction areas comprising a plurality of central junction members and at least one side junction member, said at least one side junction member comprising a first shoulder, a first intermediate section, a traverse section, a second intermediate section, and a second shoulder;

c. a plurality of corner junction areas, each of said corner junction areas comprising at least one central junction member and at least one corner junction member, said at least one corner junction member comprising a first projecting edge, a first interval section, a second interval section, a third interval section, a fourth interval section, a fifth interval section, and a second projecting edge;

d. a plurality of smooth outer wall panels engaged to said plurality of side junction members, and said plurality of corner junction members, said plurality of smooth outer wall panels forming a perimeter; and e. a plurality of smooth inner wall panels engaged to said plurality of central junction members wherein said plurality of smooth outer wall panels are substantially parallel to said plurality of smooth inner wall panels about said perimeter, and said plurality of smooth inner wall panels are substantially parallel to each other proximate to said at least one central junction area.

* * * * *